US006720854B2

(12) United States Patent
Wada et al.

(10) Patent No.: US 6,720,854 B2
(45) Date of Patent: Apr. 13, 2004

(54) IGNITION COIL HAVING AIR LAYERS AS INSULATORS AND MANUFACTURING METHOD THEREFOR

(75) Inventors: Jyunichi Wada, Chita-gun (JP); Takashi Nagata, Okazaki (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/282,112

(22) Filed: Oct. 29, 2002

(65) Prior Publication Data

US 2003/0080843 A1 May 1, 2003

(30) Foreign Application Priority Data

Oct. 30, 2001 (JP) ..... 2001-333194

(51) Int. Cl.[7] ..... H01F 27/02

(52) U.S. Cl. ..... 336/90; 336/92; 336/96; 336/192; 336/198; 123/634; 123/635

(58) Field of Search ..... 336/90, 92, 96, 336/107, 192, 198; 123/634, 635

(56) References Cited

U.S. PATENT DOCUMENTS 5,778,863 A * 7/1998 Oosuka et al. ..... 123/634
6,208,231 B1 3/2001 Oosuka et al.

* cited by examiner

*Primary Examiner*—Lincoln Donovan
*Assistant Examiner*—Jennifer A. Poker
(74) *Attorney, Agent, or Firm*—Nixon & Vanderhye PC

(57) ABSTRACT

An ignition coil has a case and a central core placed in the case. A secondary spool is wound with a secondary coil and placed outside the central core in the case. A cylindrical primary spool is wound with a primary coil and placed outside the secondary spool in the case. A resin insulator is filled in the case to maintain the insulation between each member. Air layer is partitioned in at least one of a gap between the central core and the secondary spool and a gap between the primary spool and the case.

9 Claims, 6 Drawing Sheets

IGNITION COIL HAVING AIR LAYERS AS INSULATORS AND MANUFACTURING METHOD THEREFOR

CROSS REFERENCE TO RELATED APPLICATION

This application is based on and incorporates herein by reference Japanese Patent Application No. 2001-333194 filled on Oct. 30, 2001.

FILED OF THE INVENTION

The present invention relates to an ignition coil, which can be directly installed in a plug hole of each cylinder of an engine.

BACK GROUND OF THE INVENTION

An ignition coil generates a high voltage caused by the mutual induction for an ignition plug. For example, an ignition coil disclosed in U.S. Pat. No. 6,208,231 B1 (JP-A-11-111545) is shown in FIG. 7.

The ignition coil 100 shown in FIG. 7 is inserted in a plug hole of an engine. A case 117 has a cylindrical shape and forms an outside shell of the ignition coil 100. In the center of the case 117, a center core 101 that is like a pole is installed. Around the center core 101, a secondary cylindrical spool 102 is installed. A secondary coil 107 is wound around the secondary cylindrical spool 102. A primary cylindrical spool 113 is installed around the secondary coil 107. A primary coil 115 is wound around the primary spool 113. The inside of the case 117 is filled with an epoxy resin 110 to keep the insulation between the above members, and the epoxy resin 110 glues the members to each other.

However, the coefficient of linear expansion of the members stored in the case 117 is different from that of the epoxy resin 110. Therefore, the members exert a thermal stress to each other by the compressibility or the expansion of the members caused by transition of a temperature. For example, the inner members in the case 2 such as the secondary spool 102 and the central core 101 are especially influenced by the thermal stress.

Therefore, in the ignition coil 100, the central core 101 is covered with a stress relaxation member 105. The stress relaxation member 105 is made of a lubber material and possesses the elasticity. By the elasticity, the stress relaxation member 105 can deform, and the thermal stress between the central core 101 and the epoxy resin 110 is relieved.

In the ignition coil 100, the primary spool 113 is covered with a thin layer of a film 114. The film 114 is made of a PET material, so that the adhesion to the epoxy resin 110 is weak. Therefore, the primary spool 113 and the primary coil 115 can be separated easily. By the separation, the thermal stress from the primary coil 115 to the primary spool 113, that is from the outer side to the inner side, is cut off.

Consequently, the diameter of the coil 100 is large. Because, the stress relaxation member 105 should be placed around the central core 101, and the thin layer of a film should be covered around the primary spool 113. That is, the diameter of the ignition coil 100 is limited by the diameter of the plug hole in its design.

Furthermore, the number of the members is large because the stress relaxation member 105 and the thin layer film 114 are placed. Therefore, the manufacturing cost is high. The manufacturing process is complex because the process to cover the central core 101 with a thin layer of a film is necessary.

SUMMARY OF THE INVENTION

It is an object of the present invention to provide an improved ignition coil.

According to the present invention, an ignition coil is formed to have an air layer as an insulator instead of an insulated resin in a gap between a central core and an inner spool or a gap between an outer spool and a case.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
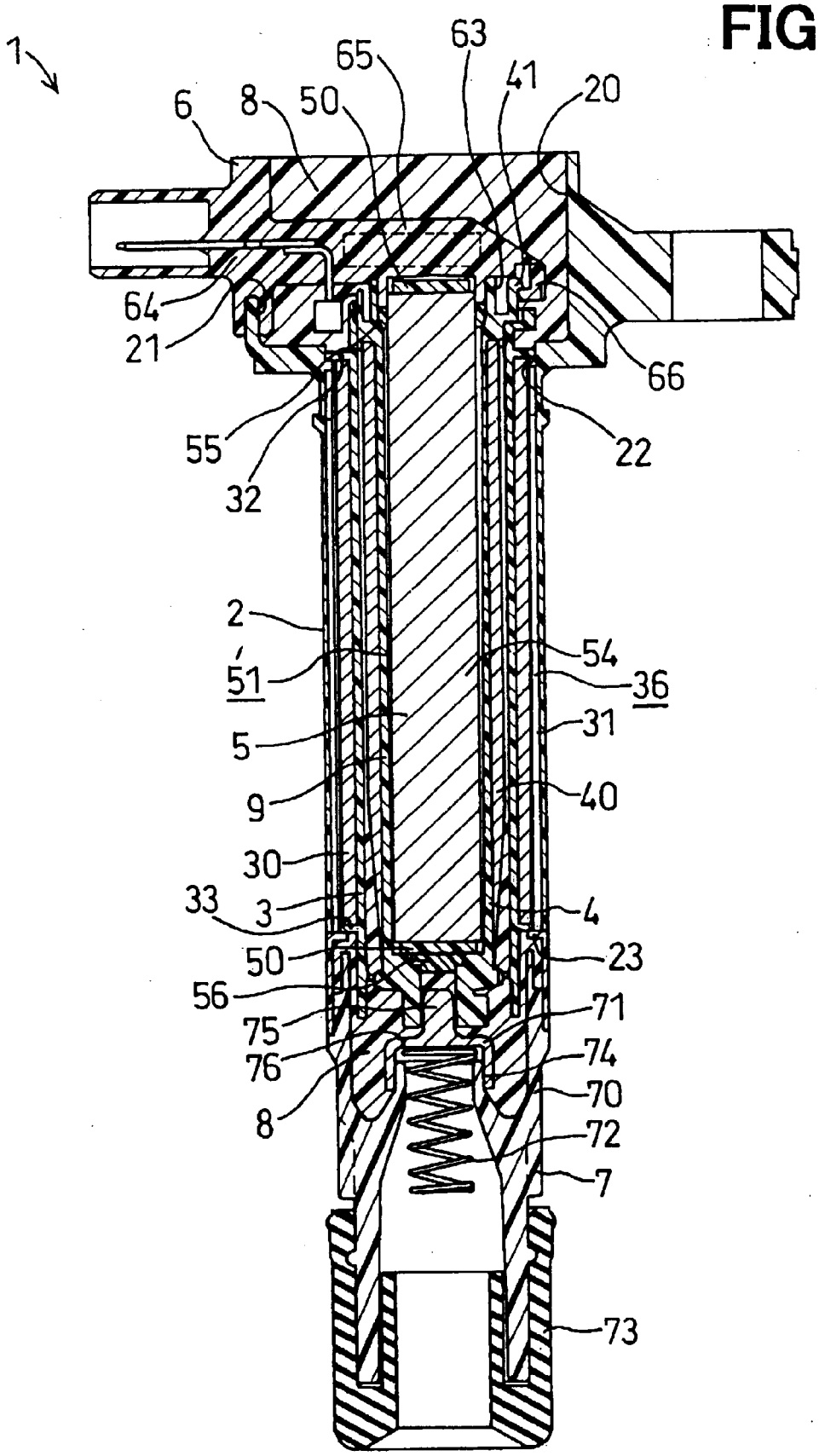
FIG. 1 is a sectional view of an ignition coil according to the first embodiment of the present invention.

Referring first to FIG. 1, an ignition coil 1 is stored in a plug hole (not shown) formed in each cylinder of an engine block. The ignition coil 1 is connected with an ignition plug (not shown) at a lower end.

The ignition coil 1 equips a case 2 made of a resin material. The case 2 is shaped as a stepped cylinder having a large diameter portion 20 at its upper end. A large diameter portion 20 is formed in an upper end of the case 2. A scraped hole 21 is formed in a part of a side wall of the larger diameter potion 20. An annular upper rib (annular inside flange) 22 is formed on the inside surface of the case 2.

A central core unit 5, a primary spool 3, a primary coil 30, a secondary spool 4, and a secondary coil 40 are stored inside the case 2.

The central core unit 5 is composed of a central core 54 and an elastic member 50. The central core 54 is composed of rectangular silicon steel sheets, and the shape of the central core 54 is like a stick. The width of the rectangular silicon steel sheets are different each other and piled in the diameter direction. The elastic member 50 is made of a silicon rubber material, and has a cylindrical shape. Two elastic members 50 are installed on both ends of the center core 54.

The secondary spool 4 is made of a resin material, and has a cylindrical shape with a bottom. The secondary spool 4 is installed in the position that the central axis of the secondary spool 4 is the same as an axis of the central core 5. The secondary spool 4 adjoins around the central core 5. The secondary coil 40 is wound around the outside surface of the secondary spool 4. Spool side hooks 41 are formed upward at the top end of the secondary spool 4. Three spool side hooks 41 are formed apart along the circumference of the top end of the secondary spool 4.

The primary spool 3 is made of a resin material, and has a cylindrical shape with a bottom. The primary spool 3 is installed in the position that the central axis of the secondary spool 3 is the same as the central axis of the secondary spool 4. The primary spool 3 adjoins outside the secondary spool 4. The primary coil 30 is wound around the outside surface of the primary spool 3. An annular upper flange 32 is formed on the upper outside surface of the primary spool 3. An annular lower flange 33 is formed on the lower outside surface of the primary spool 3. The annular upper flange 32 contacts of its lower parts against upper parts of the annular upper rib 22. In the same way, the annular lower flange 33 contacts a high voltage tower flange 23.

An epoxy resin 8 is filled between the above members in the case 2. The epoxy resin 8 permeates through the members and congeals by being poured from the larger diameter portion 20 into the case 2 evacuated in advance. The role of the epoxy resin 8 is to glue the members each other and keep an electric insulation between the members.

The epoxy resin 8 is not filled in a gap 51 between the central core 54 and the secondary spool 4. The epoxy resin 8 is not filled in a gap 36 between the primary spool 3 and the case 2. In the gap 51, a core-side enclosed air layer 9 that is partitioned by an upper cap 55 and a lower cap 56 exists. In the gap 36, a primary spool-side enclosed air layer 31 that is partitioned by the annular upper flange 32 and the high voltage tower flange 23 exists.

A connector portion 6 is placed in the large diameter portion 20. The connector 6 equips a signal input connector 64 including an igniter (electronic circuit) 65. The signal input connector 64 is made of a resin material and has a shape like a hollow rectangular projection. The signal input connector 64 is placed to project from the scraped hole 21 to the direction of the diameter.

The igniter 65 has a resin material, and has a shape like a rectangular parallelepiped. The igniter 65 is located almost in the center of the large-diameter portion 20, and is formed in a small-diameter end part of the signal input connector 64 in a body. In the upper end part of the igniter 65, an igniter side hook 66 projecting downward is formed. The three igniter side hooks 66 are located apart along the circumference. The secondary spool 4 is fixed on the igniter 65 by being hung in the igniter hooks 65 of the spool side hook 41. An annular positioning rib 63 is formed downward from the lower end part of the igniter 65. The positioning rib 63 is inserted from the top into a gap between the elastic member 50 of the central core 5 and the secondary spool 4. By the insert, the relation of the positions between the central core 5 and the secondary spool 4 in the case 2 is defined. So that a gap between the central core 5 and the secondary spool 4 is secured. A high voltage tower portion 7 is placed in the lower part of the case 2. The high voltage part 7 equips a cylindrical resin portion 70, a high voltage terminal 71, a spring 72, and a plug cap 73.

In the inside surface at the top end of the cylindrical resin portion 70, the high voltage tower flange 23 is formed. In the inside surface at a middle part of the cylindrical resin portion 70, a boss portion 74 projecting upward with its diameter becoming small is formed. The high voltage terminal 71 has a shape like a cup with a rim 76 at the bottom. The boss portion 74 is inserted in the rim 74. The high voltage terminal 71 covers the boss portion 74 like a reversed cup. From the central part of the top surface of the high voltage terminal 71, a cylindrical protuberance 75 projects upward. The protuberance 75 is inserted in the lower end of the secondary spool 4.

The spring 72 has a spiral shape. The upper end of the spring 72 is attached to the rim 76 of the high voltage terminal 71. On the other hand, at the lower end of the spring 72, an ignition plug (not shown) is inserted and fixed.

The plug cap 73 is made of a rubber material and has a cylindrical shape. The plug cap 73 is put on the lower end of the cylindrical resin portion 70. Inside the plug cap 73, the ignition plug is inserted and fixed.

A control signal is transmitted from the input connector 64 to the primary coil 30 through the igniter 65. By the mutual induction, a high voltage is generated in the secondary coil 40. The high voltage generated in the secondary coil 40 is transmitted to an ignition plug through the high voltage terminal 71 and the spring 72. The high voltage causes sparks in a gap of the ignition plug.

Figure 2:
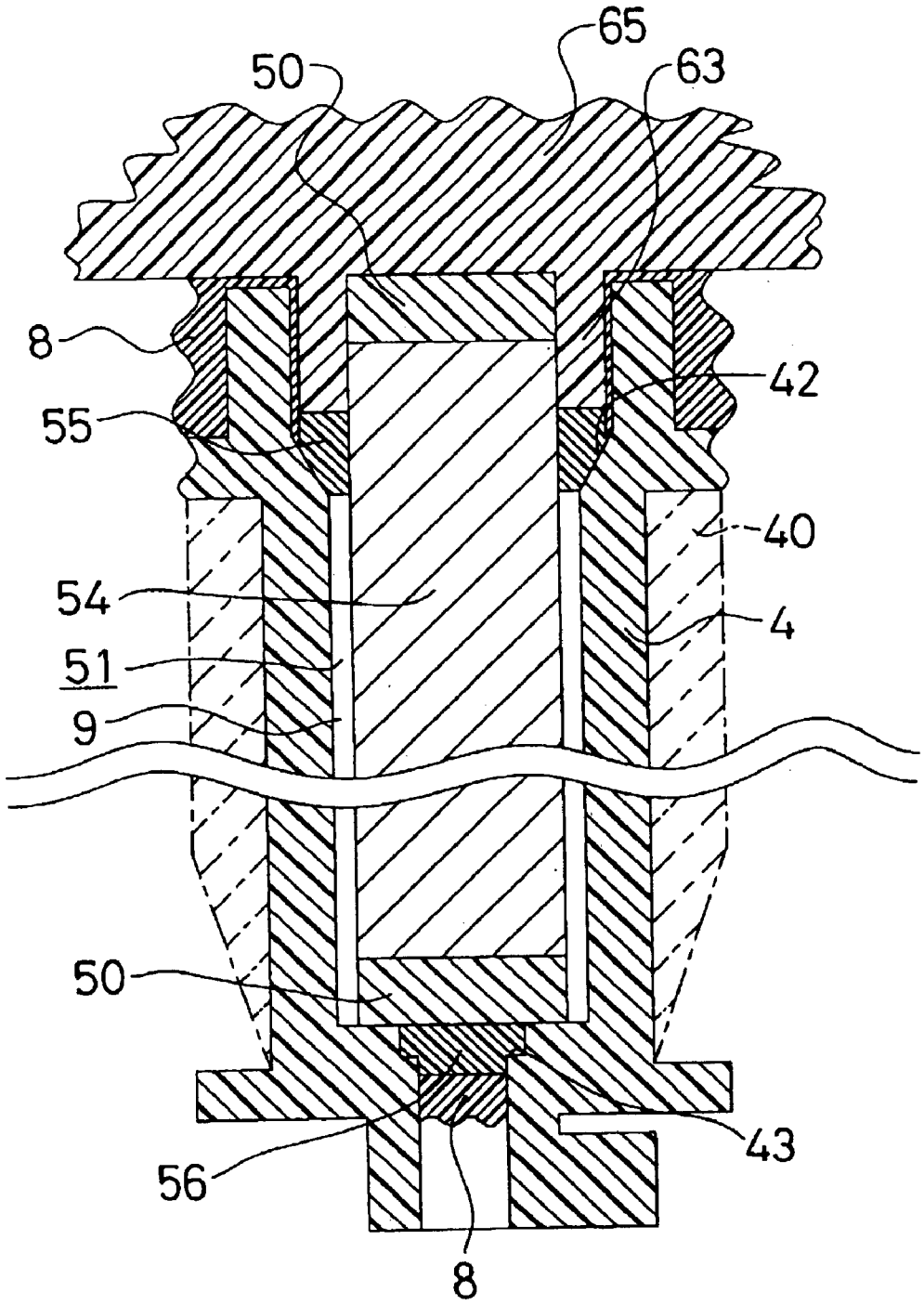
FIG. 2 is an enlarged sectional view around a central core of the ignition coil according to the first embodiment of the present invention.

In the first embodiment, as shown in FIG. 2, the core-side enclosed air layer 9 is placed in the gap 51 between the central core 54 and the secondary spool 4. The core side enclosed air layer 9 is partitioned by the upper cap 55 and the lower cap 56. The upper cap 55 is made of a resin material or a lubber material, and has a circular shape. The upper cap 55 contacts the surface of the under side of the positioning rib 63, and is fit around the upper part of the outside surface of the central core 54. That is, the inside surface of the upper cap 55 contacts the outside surface of the central core 54. The outside surface of the upper cap 55 contacts a taper portion 42 formed on the inside surface of the secondary spool 4. In this way, the upper cap 55 prevents the epoxy resin 8 from flowing in the gap 51 from the top.

On the other hand, the lower cap 56 is made of a resin material or a rubber material, and has a columned shape with a step. In other words, the lower cap has a shape like a button battery. The upper end surface of the lower cap 56 contacts the lower surface of the elastic member 50, which is placed in the lower end of the central core 54. The step portion of the lower cap 56 is inserted in the step portion 43 in the lower part of the inside surface of the secondary spool 4. That is, the outside surface of the lower cap 56 contacts with the step portion 43. In this way, the lower cap 56 prevent that the epoxy resin 8 flows in the gap 51 from the bottom.

Figure 3:
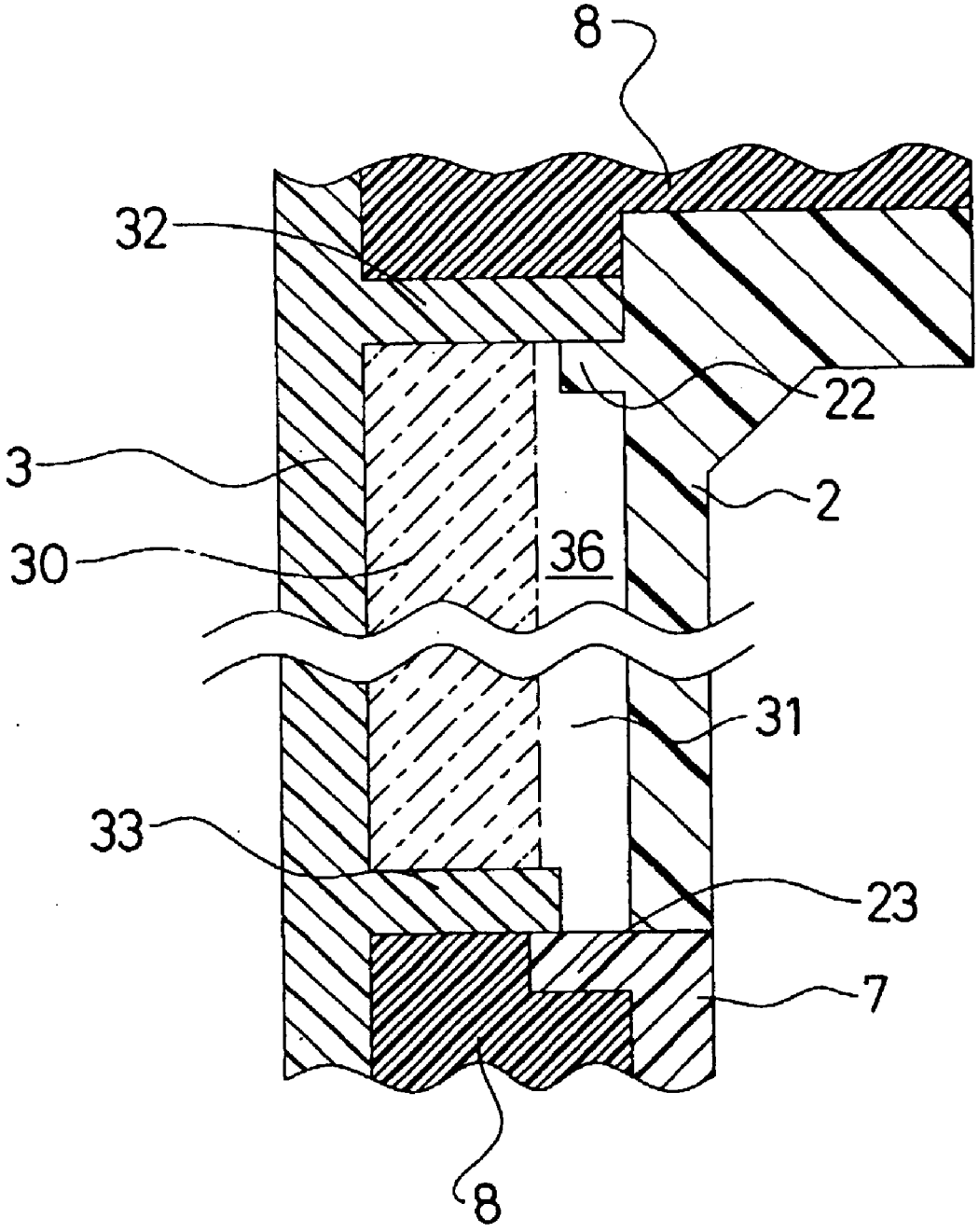
FIG. 3 is an enlarged sectional view around a primary spool of the ignition coil according to the first embodiment of the present invention.

As shown in FIG. 3, the primary spool-side enclosed air layer 31 is placed in the gap 36 between the primary spool 3 and the case 2. The primary spool-side enclosed air layer 31 is partitioned by the annular upper flange 32 and the high voltage tower flange 23. The surface at the lower end of the annular upper flange 32 contacts the surface at the upper end of the upper rib 22. By this contact, it is prevented that the epoxy resin 8 flows in the gap 36 from the top. The surface at the top end of the high voltage tower flange 23 contacts the surface at the lower end of the annular lower flange 33. It is prevented that the epoxy resin 8 flows into the gap 36 from the bottom by the contact.

In the first embodiment, the central core 54 and the secondary spool 4 are located apart, and are not glued together by the epoxy resin 8. Therefore, a stress reducing member need not be placed on the outside surface of the central core 54. The epoxy resin 8 does not permeate the primary coil 30, and the epoxy resin and the primary spool 3 are not glued together. Therefore, an exfoliation member such as a thin layer of a film need not be placed on an outside surface of the primary spool 3. Therefore, the diameter of the ignition coil 1 in EXAMPLE 1 is small.

Figure 4:
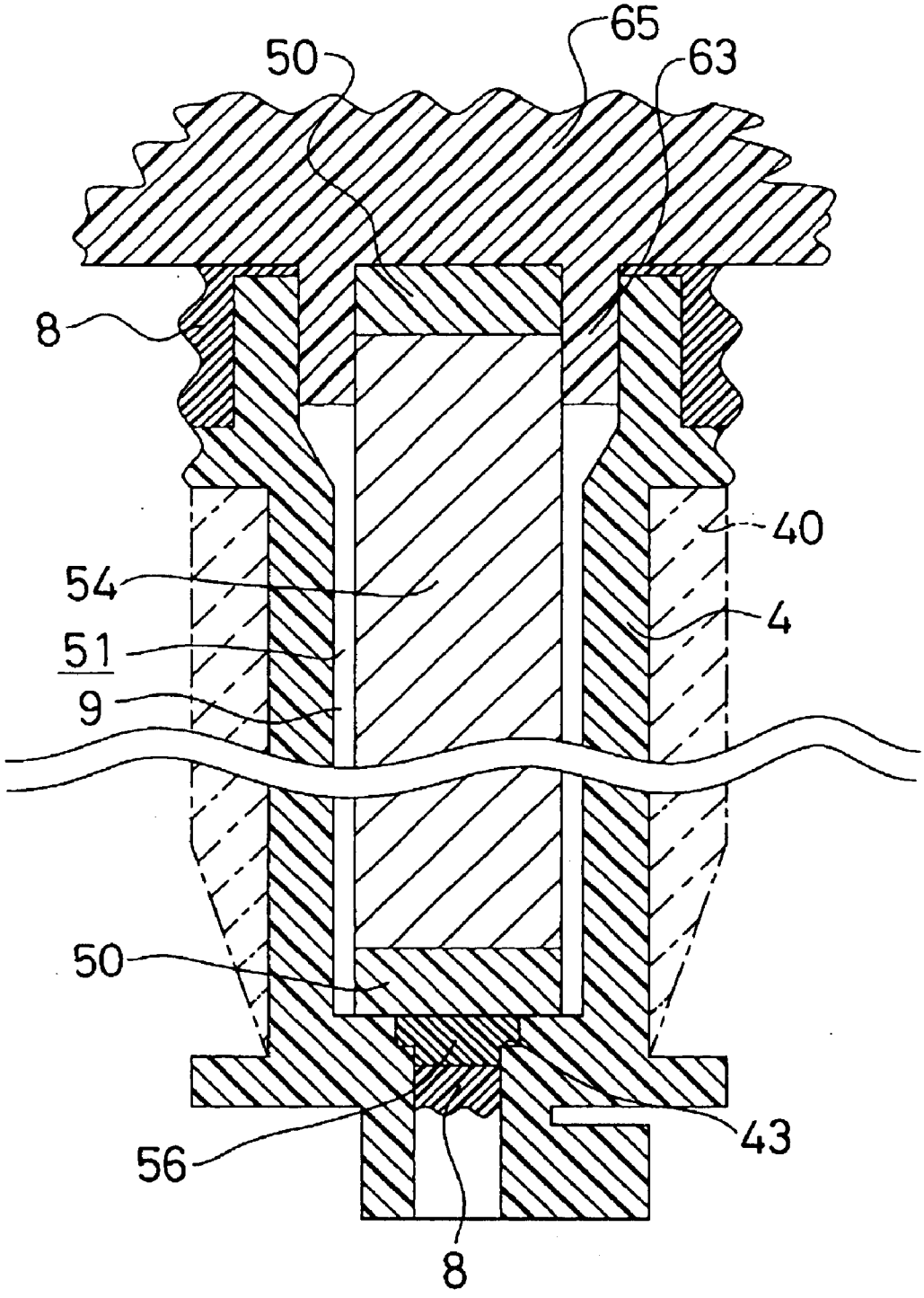
FIG. 4 is an enlarged sectional view around a central core of an ignition coil according to the second embodiment of the present invention.

In the second embodiment, as shown in FIG. 4, the positioning rib 63 is placed to directly contact the secondary spool 4. Therefore, a gap is not formed between the outside surface of the positioning rib 63 and the inside surface of the secondary spool 4. There is no gap between the positioning rib 63 and the secondary spool 4, so that the epoxy resin 8 does not permeate through gaps between those members. Therefore, the upper cap need not be placed, and the core-side enclosed air layer 9 can be partitioned only by the lower cap 56.

Figure 5:
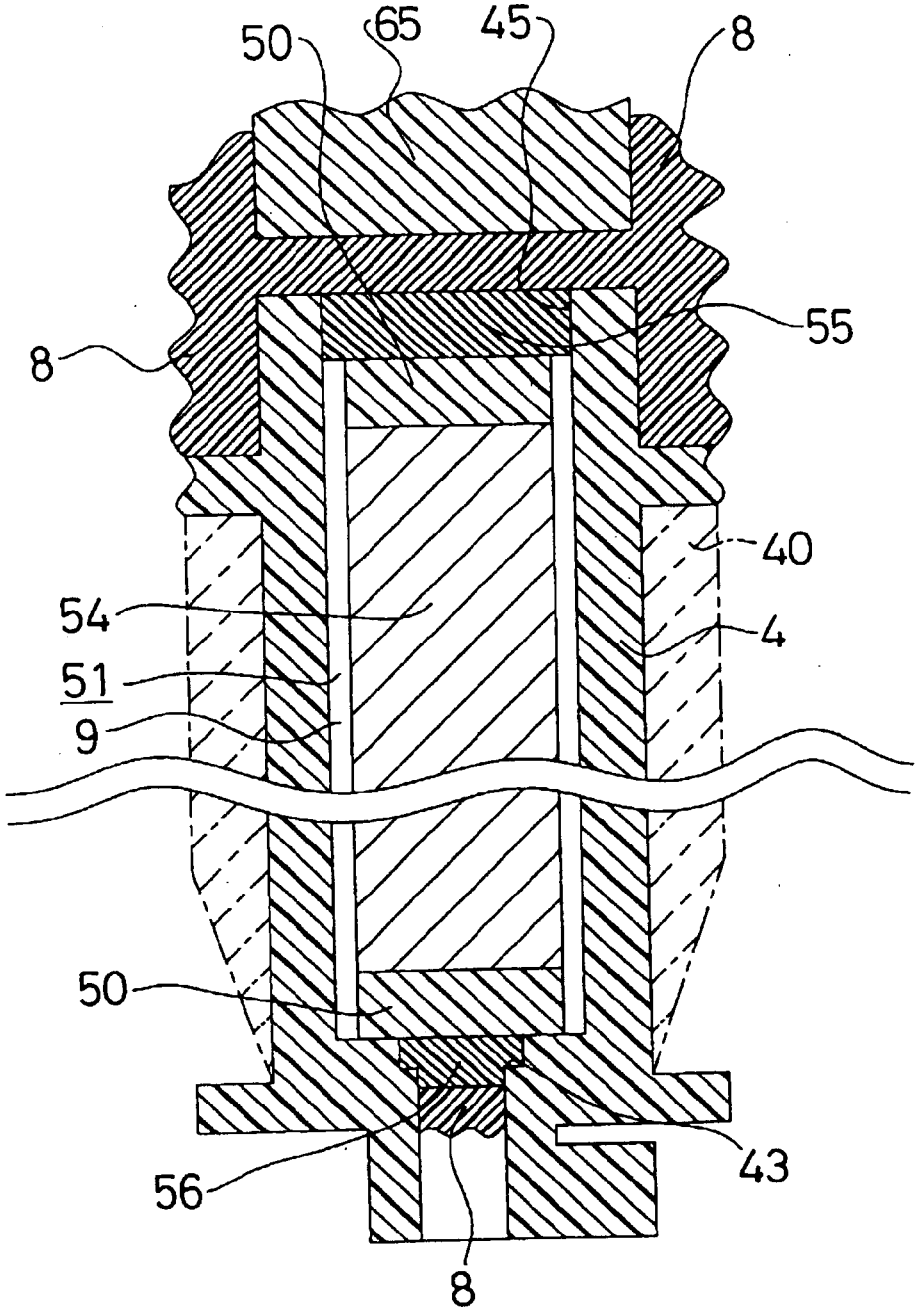
FIG. 5 is an enlarged sectional view around a central core of an ignition coil according to the third embodiment of the present invention.

In the third embodiment, as shown in FIG. 5, a positioning rib is not placed on the surface of the lower end of the igniter 65. The epoxy resin B permeates a gap 51 between the secondary spool 4 and the central core 54 through the open top 45. The upper cap 55 that is tablet-shaped is inserted in the open top 45. By this insert, the epoxy resin 8 is prevented from permeating the gap 51 from the open top 45.

Figure 6:
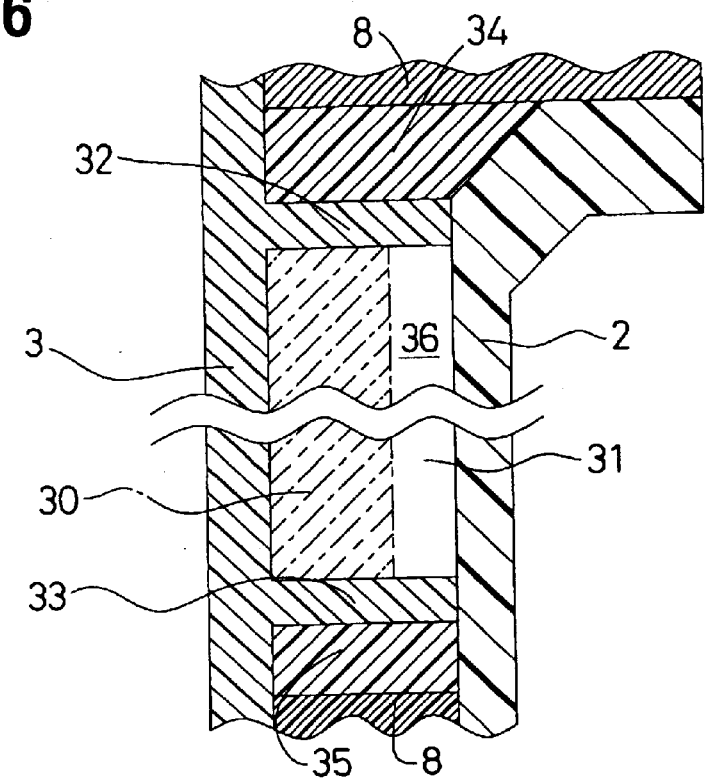
FIG. 6 is an enlarged sectional view around a primary spool of an ignition coil according to the fourth embodiment of the present invention.
Figure 7:
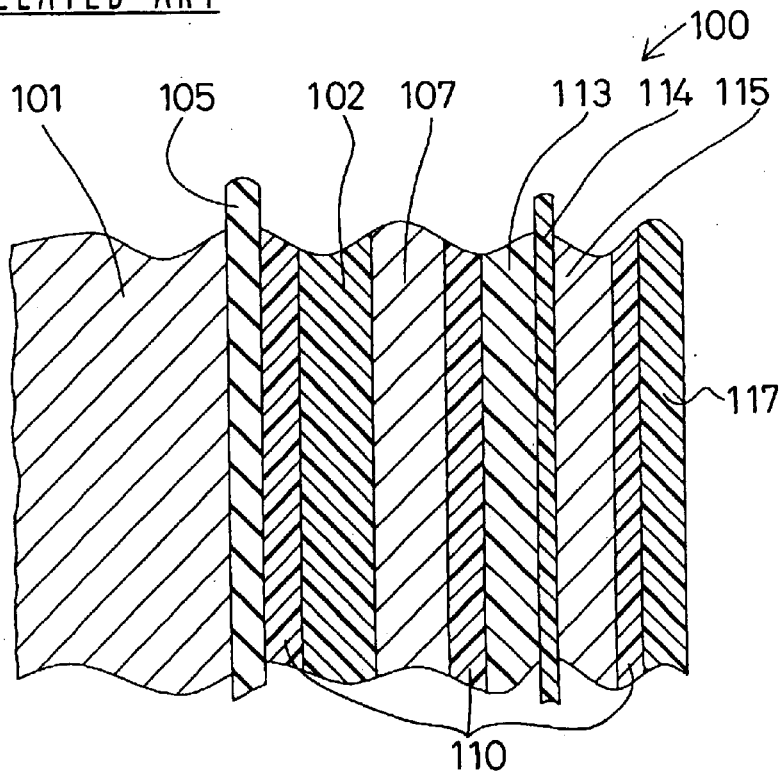
FIG. 7 RELATED ART
FIG. 7 is an enlarged sectional view of an ignition coil according to a prior art.

As shown in FIG. 6, the primary spool-side enclosed air layer 31 is partitioned by the annular upper flange 32 and the annular lower flange 33. On the annular upper flange 32, the annular upper cap 34 that is made of a resin material or a rubber material is placed. Under the annular lower flange 33, an annular lower cap 35 that is made of a resin material or a rubber material is placed. The epoxy resin 8 is prevented from flowing to the gap 36 from the top by the lower cap 34 and the annular upper flange 33. The epoxy resin 8 is prevented from flowing into the gap 36 from the bottom by the lower cap 35 and the annular lower flange 33.

The structure of the primary spool-side enclosed air layer 31 can be simplified by the simple method that the caps are placed.

In the above embodiments, the epoxy resin can be substituted by a silicon resin, a non saturated polyester resins or other. More, either one of the core-side enclosed air layer 9 and the primary spool-side enclosed air layer 31 can be eliminated. Even though there is only one enclosed air layer, the diameter of the ignition coil can be made smaller than the conventional one. The upper cap 55 or the lower cap 56 need not be used when the hermeticity can be kept. A little epoxy resin 8 can be penetrated to the gap 51 when the amount of the penetrated epoxy resin 8 does not cause a trouble in the secondary spool 4. But, all members stated in each section need not be placed when the hermeticity can be kept. For example, the primary spool-side air layer can be partitioned only by the annular upper flange 32 and the annular lower flange 33. Although a little epoxy resin 8 may be penetrated to the gap 36, as long as the amount is small, it will not cause a trouble in the members inside the primary spool 3.

What is claimed is:

1. An ignition coil comprising:

a case;

a pole-shaped central core stored inside the case;

a primary spool that is installed outside the central core and inside the case;

a primary coil wound on the primary spool;

a secondary spool that is installed around the central core and inside the primary spool;

a secondary coil wound on the secondary spool;

a resin insulator filled in the case to keep insulation in the case; and an air layer provided in at least one of a gap between the central core and the secondary spool and a gap between the primary coil and the case, wherein the air layer extends outside the central core in an axial direction of the central core, along at least a portion of a length of the central core.

2. An ignition coil according to claim 1, wherein the air layer is a hermetical air space that is not penetrated by the resin insulator.

3. An ignition coil according to claim 2, wherein the hermetical air space is partitioned by a cap to cover an open end of the gap.

4. An ignition coil according to claim 3, wherein the cap has a portion to fix a position of the central core in the case.

5. An ignition coil according to claim 4 further comprising an igniter, which inputs an ignition signal to the primary coil and is disposed over one end of the central core, wherein the cap is formed around the one end of the central core to be extended in an axial direction of the central core; and wherein an inner surface of the cap contacts an outer surface of the central core, and an outer surface of the cap contacts an inner surface of the secondary spool and thereby the cap positionally fixes the central core and the secondary spool.

6. An ignition coil comprising:

a cylindrical spool wound with a coil;

a central core stored in the spool and having a smaller diameter than the spool;

a cap portion made of an elastic material;

a filling resin filled in the ignition coil; and an electrically insulating space filled with air and bounded by an inside surface of the spool, an outside surface of the central core and the cap portion, wherein the cap portion is deformable by pressure of the filling resin thereby to prevent the filling resin from permeating the insulating space.

7. An ignition coil according to claim 6, wherein the cylindrical spool is a secondary spool, and the coil is a secondary coil that generates a high voltage supplied to a spark plug of an engine.

8. An ignition coil comprising:

a case having an inside flange on a radial inside surface thereof;

a spool stored in the case and having an outside flange on a radial outside surface thereof, the spool being wound with a coil in an axial inside surface of the outside flange;

a filling resin filled in a space between the inside surface of the case and the outside surface of the spool where the coil is absent; and an electrically insulating space filled with air and bounded by the coil, the outside flange of the spool and the case, wherein the outside flange of the spool is positioned axially adjacent to the inside flange of the case, and the outside flange is axially pressed on the inside flange by the filling resin, so as to prevent the filling resin from permeating the insulating space.

9. An ignition coil according to claim 8, wherein the spool is a primary spool for a primary coil connected to an igniter that controls ignition.

* * * * *